US007975841B2

(12) United States Patent
Marco et al.

(10) Patent No.: US 7,975,841 B2
(45) Date of Patent: Jul. 12, 2011

(54) FLEXIBLE CARRIER

(75) Inventors: Leslie S. Marco, Westmont, IL (US); Jay A. Saltzman, Hinsdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 267 days.

(21) Appl. No.: 12/201,621

(22) Filed: Aug. 29, 2008

(65) Prior Publication Data

US 2009/0057354 A1 Mar. 5, 2009

Related U.S. Application Data

(60) Provisional application No. 60/967,217, filed on Aug. 31, 2007.

(51) Int. Cl.
*B65D 75/00* (2006.01)

(52) U.S. Cl. ..... 206/150

(58) Field of Classification Search ..... 206/150, 206/151, 153, 446, 426, 427, 428; 294/87.2
See application file for complete search history.

(56) References Cited

U.S. PATENT DOCUMENTS

| | | | |
|---|---|---|---|
| 2,535,880 | A | 12/1950 | Tomkins |
| 2,949,179 | A | 8/1960 | Busse |
| 2,955,707 | A | 10/1960 | Foote |
| 2,989,177 | A | 6/1961 | Swick |
| 3,522,890 | A | 8/1970 | Birchall |
| 3,570,685 | A | 3/1971 | Carlson |
| 3,612,299 | A | 10/1971 | Shaw et al. |
| 3,645,410 | A | 2/1972 | Powell |
| 3,659,726 | A | 5/1972 | Anderson |
| 3,718,246 | A | 2/1973 | Dardaine et al. |
| 3,788,497 | A | 1/1974 | Carlson |
| 3,815,947 | A | 6/1974 | Olsen |
| 3,897,872 | A | 8/1975 | Graser |
| 3,930,578 | A | 1/1976 | Stein |
| 3,934,713 | A | 1/1976 | Van der Meer et al. |
| 4,036,391 | A | 7/1977 | Prodel |
| 4,093,295 | A | 6/1978 | Erickson |
| 4,098,050 | A | 7/1978 | Dietz et al. |
| 4,237,673 | A | 12/1980 | Calvert et al. |
| 4,356,914 | A | 11/1982 | Olsen et al. |
| 4,390,095 | A | 6/1983 | Cunningham |
| 4,460,084 | A | 7/1984 | Miller |
| 4,637,509 | A | 1/1987 | Raudat et al. |

(Continued)

FOREIGN PATENT DOCUMENTS

| | | |
|---|---|---|
| EP | 0 093 302 | 11/1983 |

(Continued)

OTHER PUBLICATIONS

J. G. Miller et al., "Flight Bar Assembly, Apparatus and Methods for Nestable Collation of Objects," filed Jun. 24, 2009, U.S. Appl. No. 12/490,967 (34 pages).

*Primary Examiner* — Luan K Bui
(74) *Attorney, Agent, or Firm* — Pauley Petersen & Erickson

(57) ABSTRACT

A flexible carrier for carrying a plurality of containers includes a flexible sheet and a plurality of container receiving apertures formed in the flexible sheet wherein the plurality of container receiving apertures are formed in a staggered array wherein each row within the array includes a different number, offset and/or geometry of container receiving apertures from each adjacent row.

4 Claims, 9 Drawing Sheets

U.S. PATENT DOCUMENTS

| | | | | | |
|---|---|---|---|---|---|
| 4,756,139 | A | | 7/1988 | Le Bras | |
| 4,782,955 | A | * | 11/1988 | Weaver et al. | 206/150 |
| 4,834,605 | A | | 5/1989 | Jerred | |
| 4,850,479 | A | * | 7/1989 | Bird | 206/150 |
| 4,915,217 | A | * | 4/1990 | Karabedian et al. | 206/150 |
| 4,930,633 | A | | 6/1990 | Gloyer | |
| 4,934,508 | A | | 6/1990 | Vander Meer et al. | |
| 4,936,077 | A | | 6/1990 | Langen et al. | |
| 5,020,661 | A | | 6/1991 | Marco | |
| 5,065,670 | A | | 11/1991 | Leiweke | |
| 5,080,551 | A | | 1/1992 | Jerred | |
| 5,238,101 | A | | 8/1993 | Ota et al. | |
| 5,267,644 | A | | 12/1993 | Tsao | |
| 5,271,709 | A | | 12/1993 | VanderMeer et al. | |
| 5,320,457 | A | | 6/1994 | VanderMeer et al. | |
| 5,328,021 | A | | 7/1994 | Calvert et al. | |
| 5,360,099 | A | | 11/1994 | Culpepper et al. | |
| 5,369,942 | A | | 12/1994 | Olson | |
| 5,439,110 | A | | 8/1995 | Regan, II | |
| 5,443,298 | A | * | 8/1995 | Finley et al. | 294/87.2 |
| 5,477,655 | A | | 12/1995 | Hawley | |
| 5,522,692 | A | | 6/1996 | Simkowski | |
| 5,546,734 | A | | 8/1996 | Moncrief et al. | |
| 5,667,055 | A | | 9/1997 | Gambetti | |
| 5,853,088 | A | | 12/1998 | Saulas et al. | |
| D408,277 | S | | 4/1999 | Erickson | |
| 5,904,026 | A | | 5/1999 | Irvine | |
| 6,039,181 | A | * | 3/2000 | Whiteside | 206/428 |
| 6,688,839 | B1 | | 2/2004 | Hirschek et al. | |
| 6,793,064 | B2 | | 9/2004 | Schoeneck et al. | |
| 6,837,360 | B2 | | 1/2005 | Schoeneck | |
| 7,073,656 | B2 | | 7/2006 | Gust et al. | |
| 7,100,762 | B2 | * | 9/2006 | Marco | 206/150 |
| 7,775,348 | B2 | * | 8/2010 | Olsen et al. | 206/150 |
| 2001/0032855 | A1 | | 10/2001 | Bergeron | |
| 2004/0055905 | A1 | | 3/2004 | Marco et al. | |
| 2005/0279650 | A1 | | 12/2005 | Marco | |
| 2006/0086063 | A1 | | 4/2006 | Magomedov | |

FOREIGN PATENT DOCUMENTS

| | | |
|---|---|---|
| GB | 2 324 075 | 11/2008 |

* cited by examiner

FLEXIBLE CARRIER

CROSS REFERENCE TO RELATED APPLICATION

This application claims the benefit of U.S. Provisional Patent Application Ser. No. 60/967,217, filed 31 Aug. 2007.

BACKGROUND OF THE INVENTION

1. Field of the Invention

This invention relates to a flexible carrier for carrying a plurality of containers such as bottles or cans.

2. Description of Prior Art

Conventional container carriers are often used to unitize a plurality of similarly sized containers, such as cans, bottles and/or similar containers that require unitization. Plastic ring carriers having a plurality of container apertures are one such conventional container carrier.

Conventional carriers include multi-packaging devices that engage the chime, rim or rib around the upper portion of the container, called "rim-applied carriers" or "RAC carriers". Another conventional carrier is the sidewall-applied carrier, called "SAC carriers," wherein the multi-packaging device engages the sidewall of the containers.

Conventional carriers are arranged in aligned arrays of longitudinal rows and transverse ranks of container receiving apertures. A common arrangement is two rows of three ranks of longitudinally and transversely aligned container receiving apertures forming six total container receiving apertures and a "six-pack." Other common configurations include two rows of four ranks forming an eight container multipackage and three rows of four ranks forming a twelve container multipackage.

SUMMARY OF THE INVENTION

The present invention is directed to a flexible carrier for containers which includes a flexible sheet and a plurality of container receiving apertures formed in the flexible sheet. A staggered array of the container receiving apertures extend across the flexible sheet wherein each row of container receiving apertures preferably includes a distinct number, offset and/or geometry from each adjacent row.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
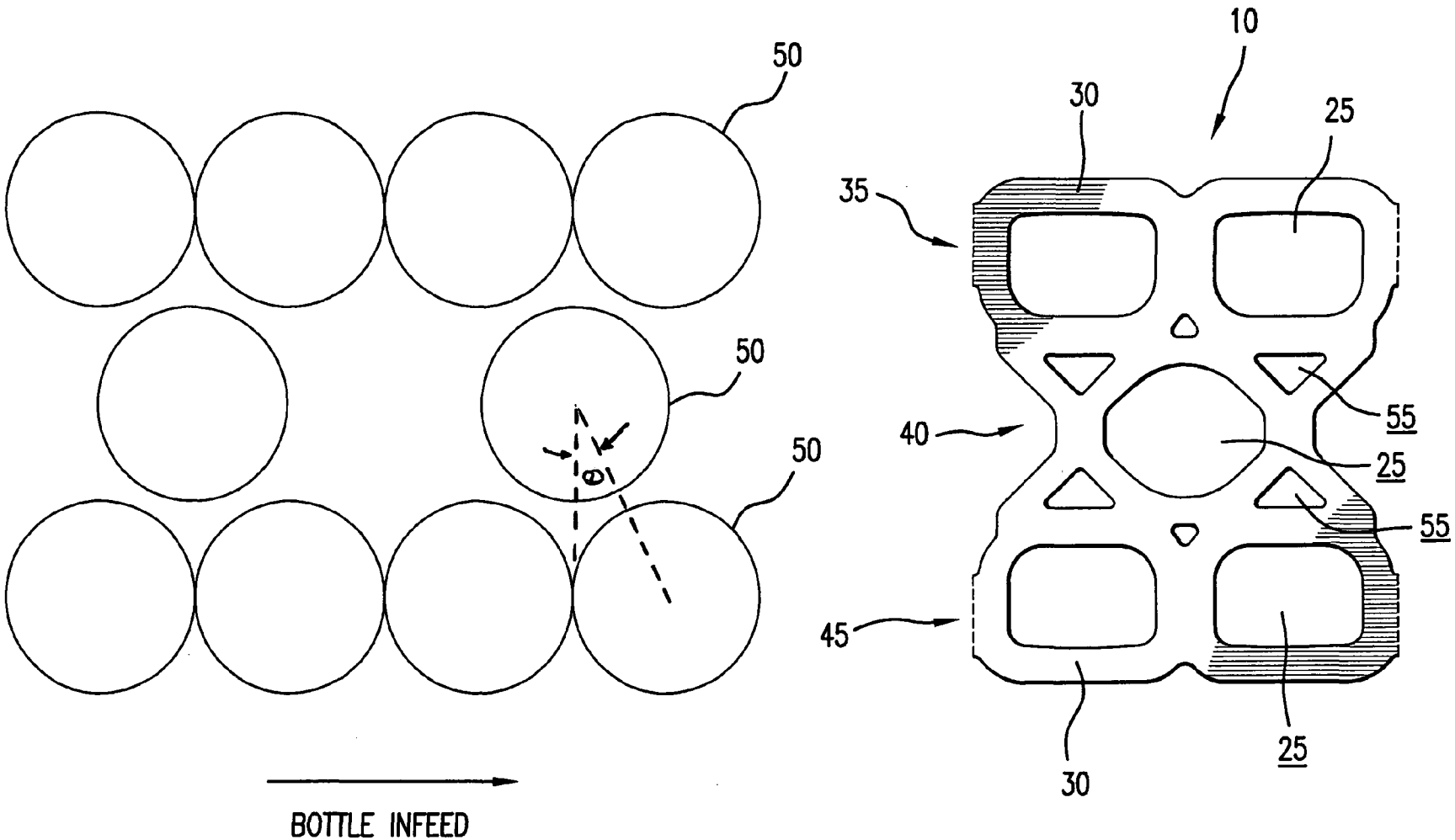
FIG. 1 is a top elevational view of a container carrier and a plurality of containers prior to application according to one preferred embodiment of this invention.
Figure 2:
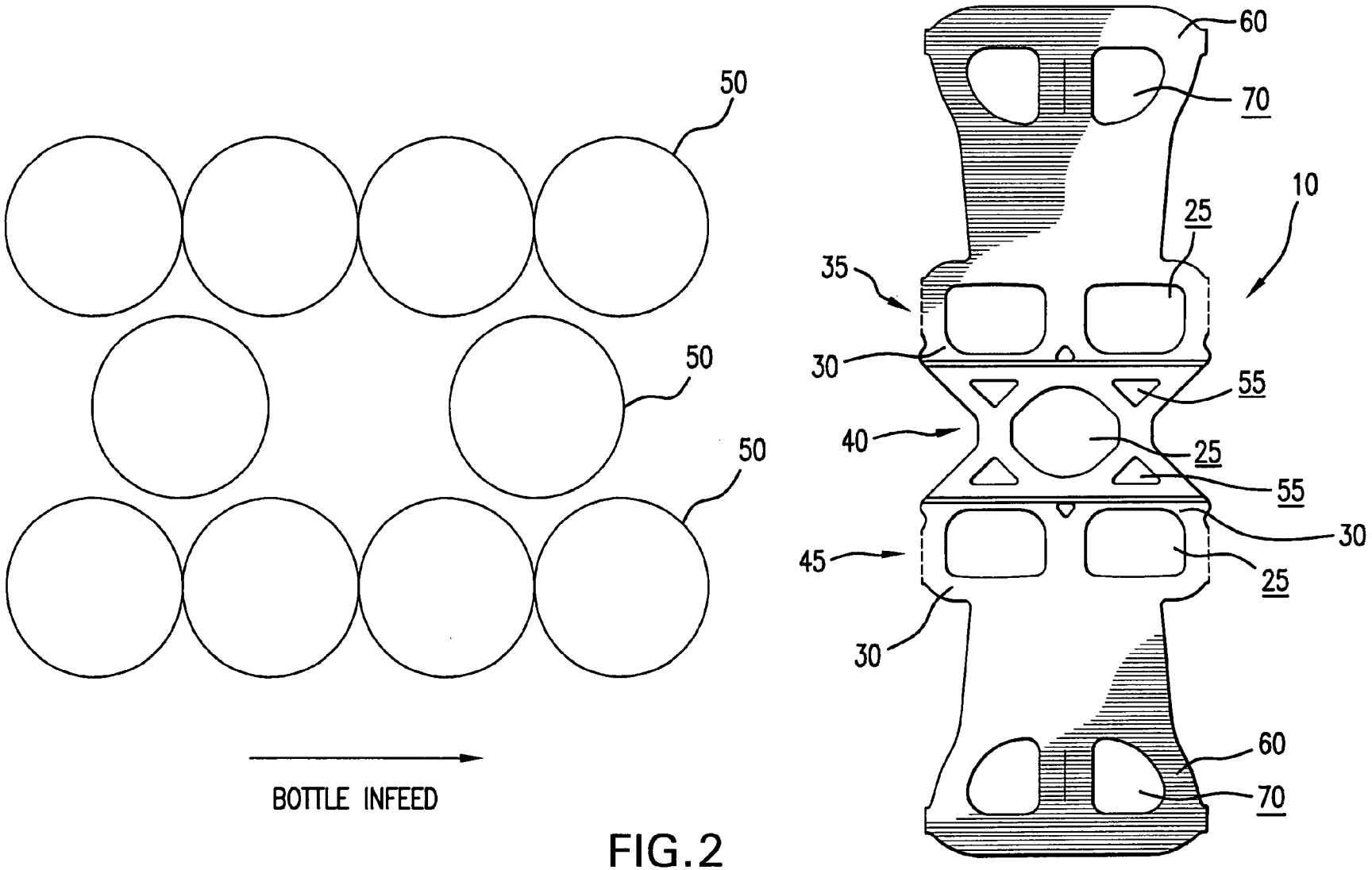
FIG. 2 is a top elevational view of a container carrier and a plurality of containers prior to application according to one preferred embodiment of this invention.
Figure 3:
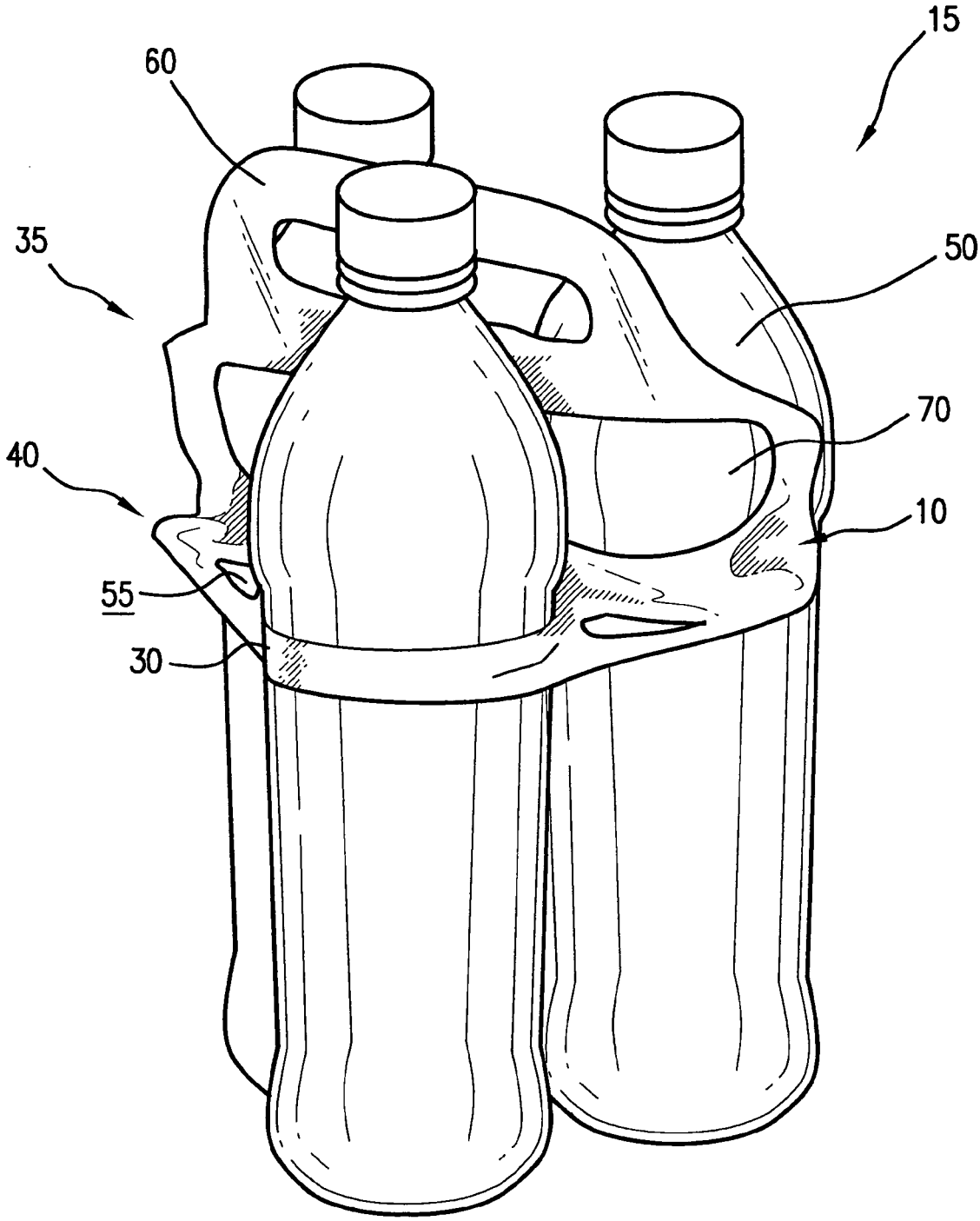
FIG. 3 is a side perspective view of a package of containers according to one preferred embodiment of this invention.
Figure 7:
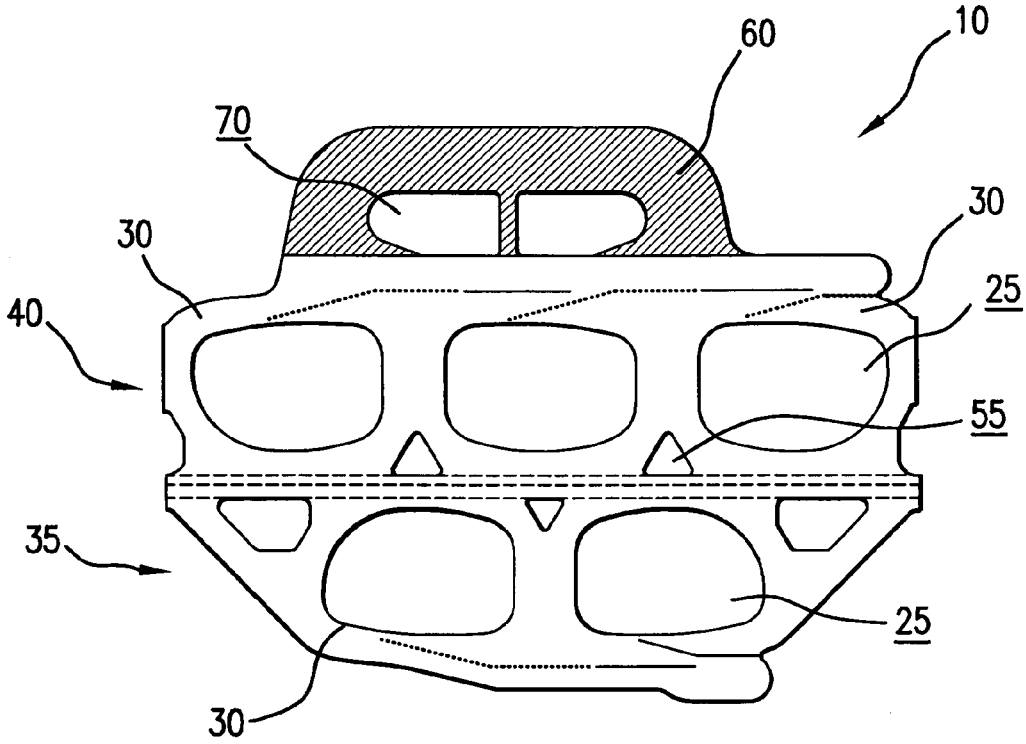
FIG. 7 is a top elevational view of a flexible carrier for unitizing five containers according to one preferred embodiment of this invention.
Figure 8:
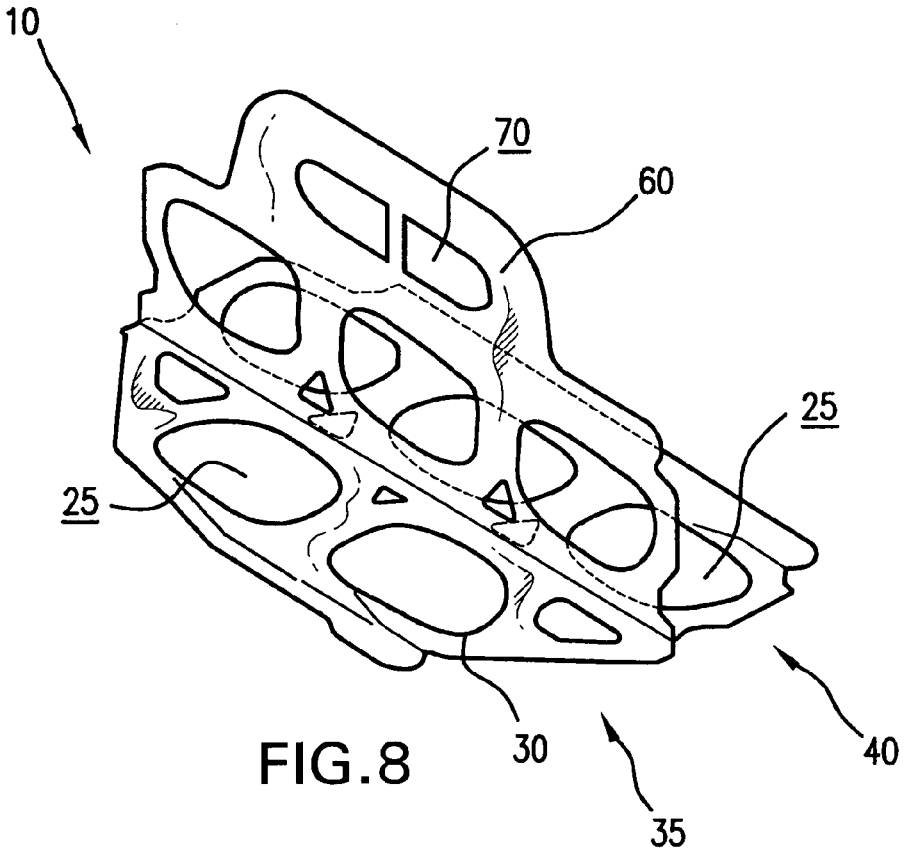
FIG. 8 is a front perspective view of the flexible carrier for unitizing five containers shown in FIG. 7 including a handle in an extended state.
Figure 9:
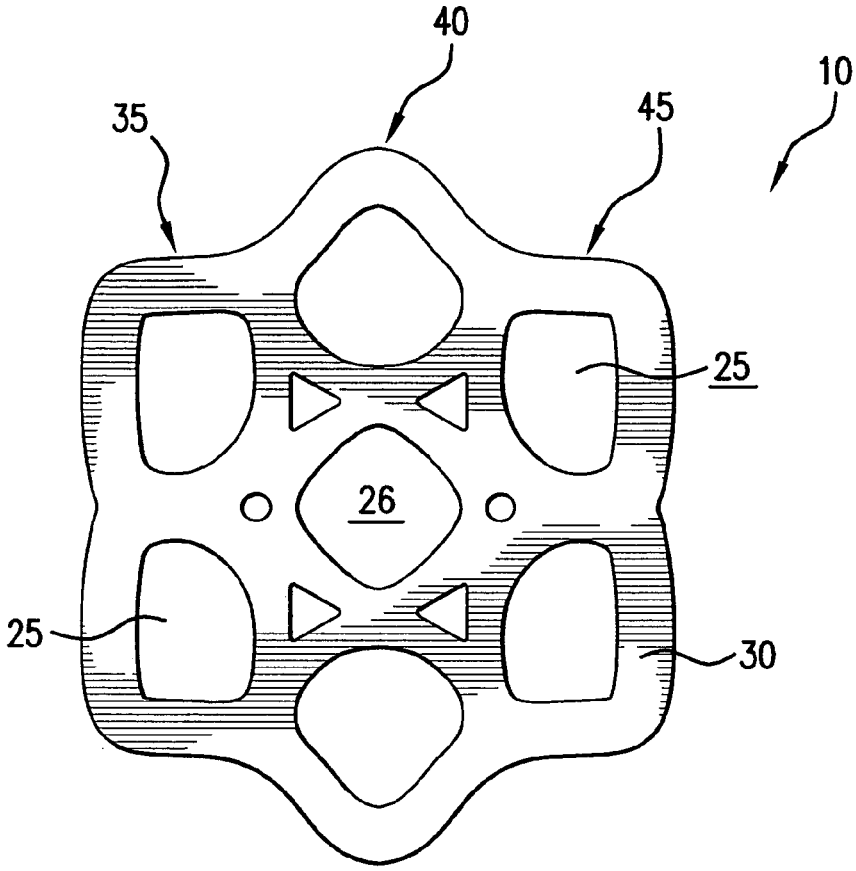
FIG. 9 is a top elevational view of a container carrier according to one preferred embodiment of this invention.
Figure 10:
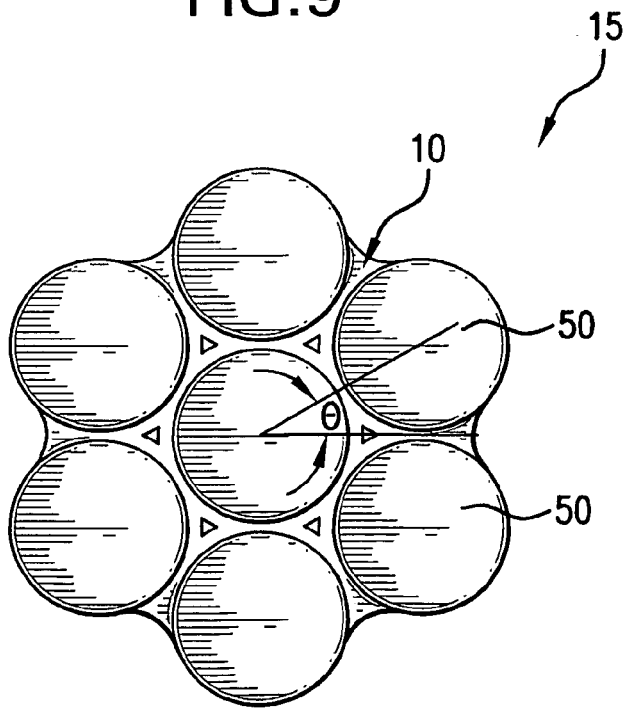
FIG. 10 is a top elevational view of a container carrier and a plurality of containers following application according to one preferred embodiment of this invention.
Figure 11:
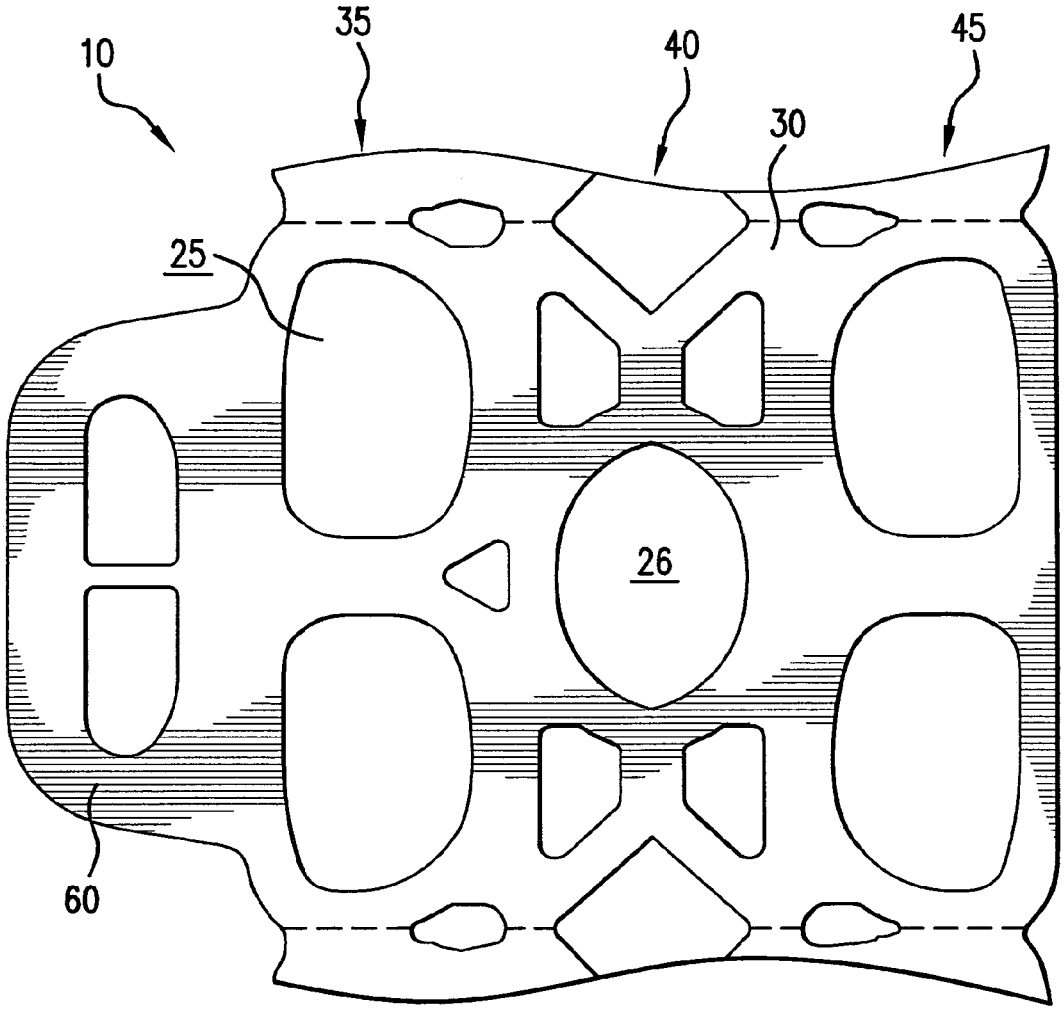
FIG. 11 is a top elevational view of a container carrier according to one preferred embodiment of this invention.

FIGS. 1-11 show various preferred embodiments of flexible carrier 10 according to this invention. For example, FIGS. 1, 2, 4-8 and 11 show various embodiments of flexible carrier 10 and/or package 15 of five containers 50. FIG. 3 shows one preferred embodiment of flexible carrier 10 and package 15 of three containers 50. FIGS. 9 and 10 show a preferred embodiment of flexible carrier 10 and package 15 having seven containers 50. Flexible carriers 10 generally include a plurality of container receiving apertures 25 that are each stretched around container 50 to form a unitized package 15 of containers 50.

FIGS. 1 and 2 illustrate flexible carrier 10 according to two preferred embodiments of this invention. As described in more detail below, portions of flexible carrier 10 are stretched a sufficient amount to permit a tight, gripping engagement with containers 50. This tight, gripping engagement also maximizes the amount of material of the flexible carrier 10 positioned in the vertical plane, i.e., in contact with the sidewalls of containers 50.

The figures illustrate various structures for flexible carrier 10 of the invention. The illustrations are exemplary, and the invention is not limited to the flexible carriers 10 or packages shown. Each flexible carrier 10 preferably includes flexible sheet 20 defining a plurality of container receiving apertures 25, each for receiving a container 50. Flexible sheet 20 includes bands or rings of material, termed container receiving portions 30 herein, that surround each container receiving aperture 25. Such container receiving portions 30 stretchingly engage or grip the respective containers to form a unitized package of containers 50.

As shown in the figures, each flexible carrier 10 according to this invention features a staggered array of container receiving apertures 25. As used herein, the term "staggered array" is defined as an arrangement of container receiving apertures 25 wherein adjacent rows of container receiving apertures include different numbers and/or offsets relative to each other. Further, unlike traditional packages that include containers aligned in both lateral and longitudinal directions, package 15 according to this invention preferably includes adjacent containers that are staggered at an angle θ, preferably 30 degrees, such as shown in FIGS. 1 and 10.

Specifically, an array of container receiving apertures 25 that includes first and second adjacent longitudinal 35, 40 rows of aligned apertures wherein there exists one aperture in said first row 35 that spans two adjacent apertures in said second row 40 such that a transverse axis extending from one longitudinal extent of said one aperture intersects a first aperture in said second row 40 and a transverse axis extending from the opposite longitudinal extent of said one aperture intersects a second aperture in said second row 40.

Figure 4:
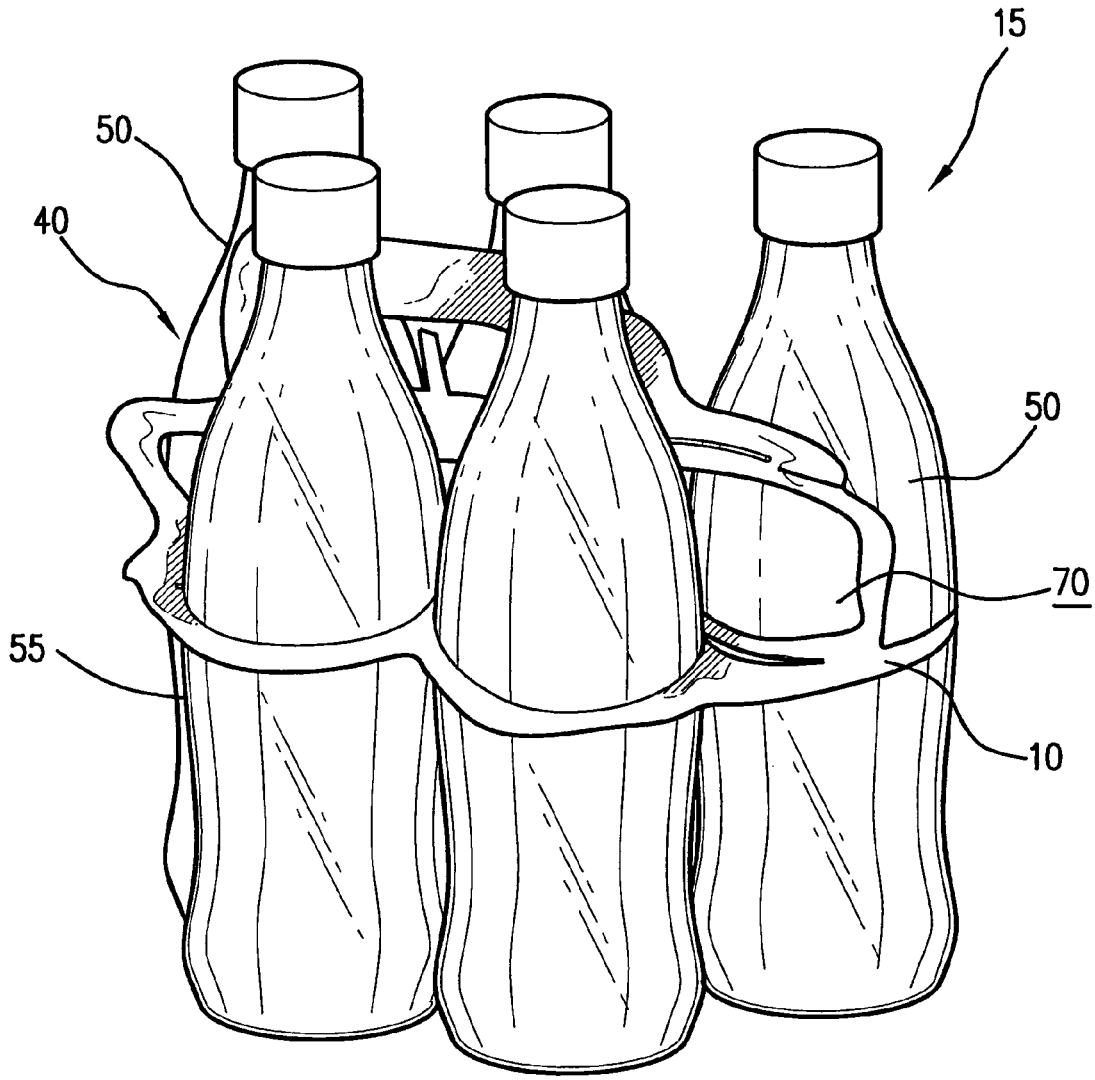
FIG. 4 is a side perspective view of a package of containers according to one preferred embodiment of this invention.
Figure 5:
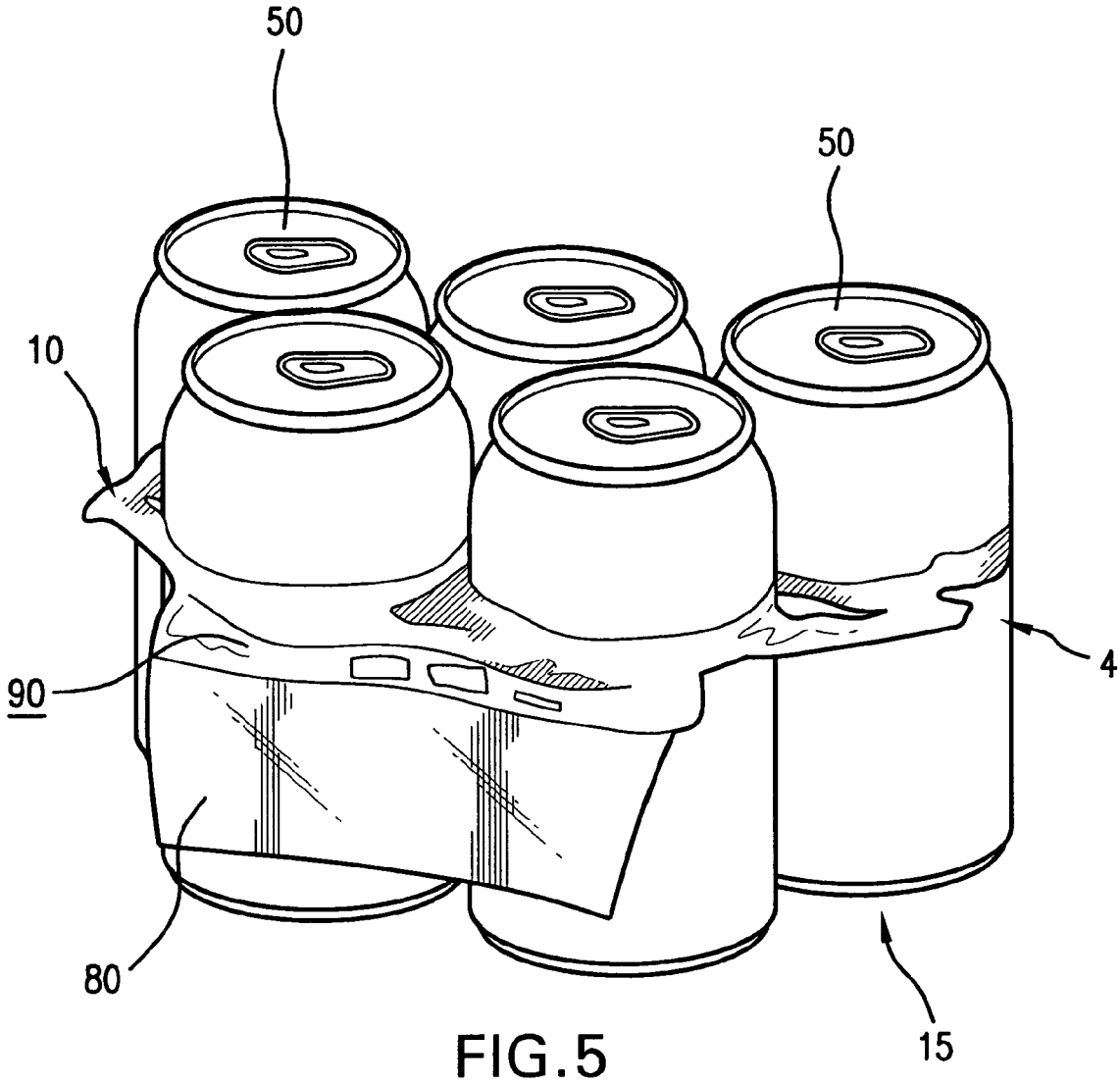
FIG. 5 is a side perspective view of a package of containers according to one preferred embodiment of this invention.

For example, as shown in FIGS. 3-5, the staggered array of container receiving apertures 25 in flexible carrier 10 includes a first row 35 having an even number of container receiving apertures 25 and a second row 40 having an odd number of container receiving apertures 25. In addition, the offset of each adjacent row of container receiving apertures 25 is different in that a central portion of each container receiving aperture 25 in the first row 35 is generally aligned with an edge portion of each adjacent container receiving aperture 25 in the second row 40.

Specifically, as shown in FIG. 3, the first row 35 may comprise one container receiving aperture 25 and the second row 40 may comprise two container receiving apertures 25, for a total package size of three containers 50. Alternatively, as shown in FIG. 3, the first row 35 may comprise two container receiving apertures 25 and the second row may comprise three container receiving apertures 25, for a total package size of five containers 50.

As shown in FIGS. 3-5, following application of flexible carrier 10 to a plurality of containers 50, at least one container 50 in the second row 40 of the staggered array contacts at least two containers 50 in the first row 35. This arrangement contrasts with a typical package in the prior art that includes an aligned array of container receiving apertures whereby each container receiving aperture is aligned longitudinally and transversely with each adjacent container receiving aperture. As a result, in the prior art, a container will generally contact a longitudinally adjacent container (within the same row) and a transversely adjacent container (within the same rank).

Figure 6:
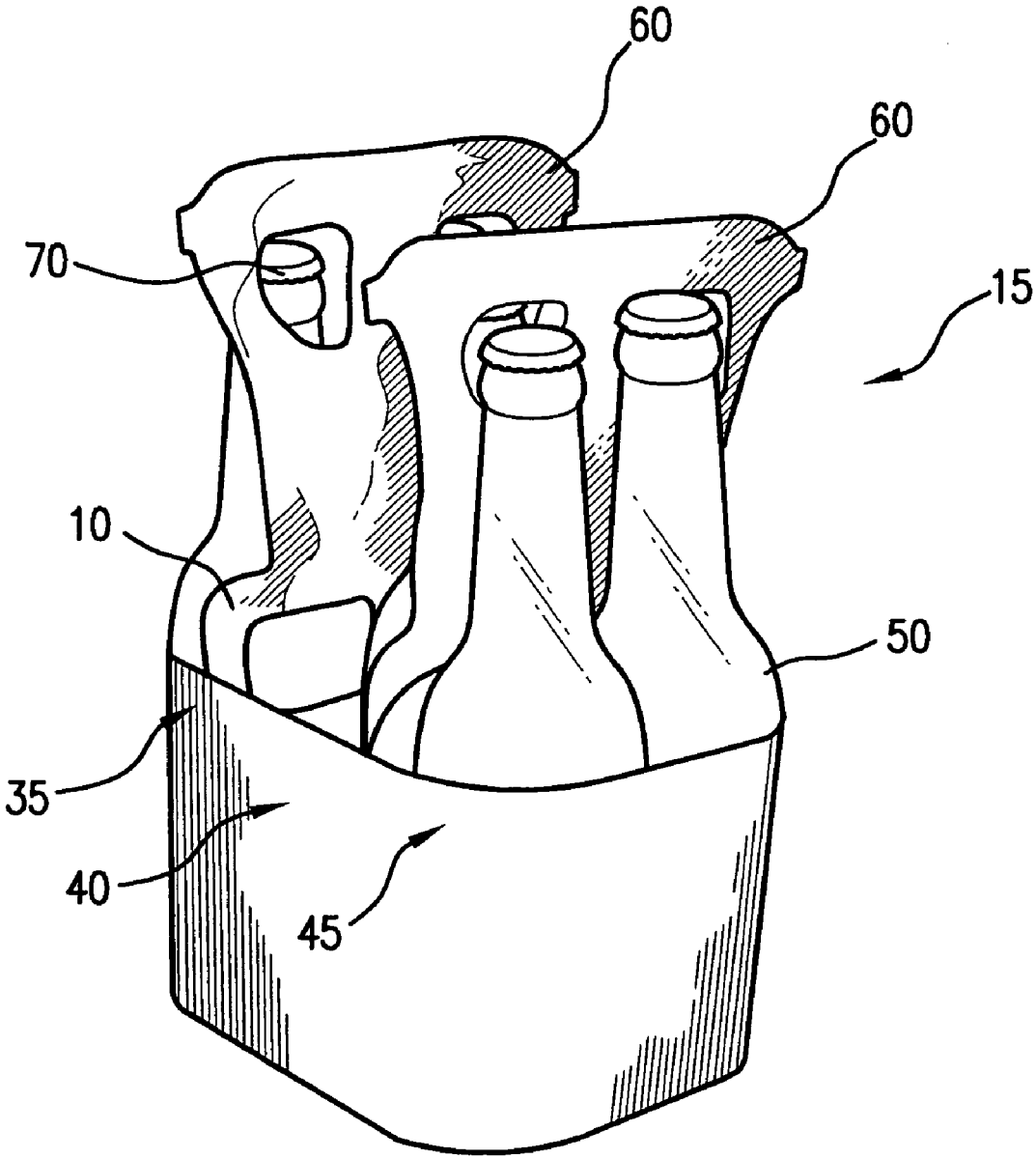
FIG. 6 is a side perspective view of a package of containers according to one preferred embodiment of this invention.

According to one preferred embodiment of this invention, such as shown in FIGS. 1, 2 and 6, flexible carrier 10 may further include a third row 45 of container receiving apertures 25. Like the variations shown in FIGS. 3-5, the third row 45 may include any suitable number of containers 50. Generally, the first row 35 and the third row 45 will include an equal number of container receiving apertures 25, although alternative embodiments may exist wherein this is not the case.

As best shown in FIGS. 1 and 2, according to a preferred embodiment of this invention, container receiving apertures 25 in the first row 35 may include a different geometry than container receiving apertures 25 in the second row 35. As such, in addition to numbers and offsets, adjacent rows of container receiving apertures 25 may include distinct geometries.

The containers, such as those shown in packages in FIGS. 4 and 5, are preferably cans. Although cans are shown in FIGS. 4 and 5, bottles or any other commonly unitized container may be used with flexible carrier 10 according to this invention. The containers are preferably like-sized within a single flexible carrier 10.

As shown in FIGS. 3, 4 and 6, flexible carrier 10 may further include an integral handle 60 extending generally upwardly from package 15. According to this embodiment of the invention, one or more handle apertures 70 are positioned between handle 60 and the remainder of flexible sheet 20. Handle aperture 70 preferably includes a notch or indentation extending between each container receiving aperture 25 positioned within flexible sheet 20. Handle aperture 70 both provides a void within which to grasp resulting package and permits a flexible interface between handle 60 and remainder of flexible sheet 20.

Specifically, as shown in FIGS. 3 and 4, handle 60 may extend between each row of container receiving apertures 25. Alternatively, as shown in FIG. 2, flexible carrier 10 may include a pair of handles 60, each handle 60 extending between a row of container receiving apertures 25. Alternatively, as shown in FIG. 6, flexible carrier 10 may include a pair of handles 60, each handle 60 extending from an outside of the first row 35 and an outside of the third row 45.

According to an embodiment of the invention shown in FIGS. 7 and 8, handle 60 may overlay the first row 35 or the second row 40 prior to application of flexible carrier 10 to the plurality of containers 50, such as shown in FIG. 7. FIG. 8 shows flexible carrier 10 having handle 60 extending upwardly as it would following application of flexible carrier 10 to a plurality of containers 50.

As shown in FIGS. 9 and 10, flexible carrier 10 according to this invention features a staggered array of container receiving apertures 25 including 3 rows of container receiving apertures 25. In addition, or alternatively, as shown in FIG. 10, package 15 may include a hexagonal shaped array, whereby a central container includes a plurality of radially spaced containers. Such array may be arranged radially, as shown in FIG. 10, and/or arranged in three staggered rows as more clearly shown in FIG. 9. As shown in the figures, the resulting package 15 is a truly staggered array, that is, the number of containers in both the x and y directions are different in each adjacent row or rank.

As shown in FIGS. 9 and 10, the staggered array of container receiving apertures 25 in flexible carrier 10 includes a first row 35 having an even number of container receiving apertures 25; a second or middle row 40 having an odd number of container receiving apertures 25; and a third row 45 having an even number of container receiving apertures 25, typically equal to the number in the first row 35. In addition, the offset of each adjacent row of container receiving apertures 25 is different in that a central portion of each container receiving aperture 25 in the first row 35 is generally aligned with an edge portion of each adjacent container receiving aperture 25 in the second row 40. Such an arrangement may additionally facilitate the radial arrangement of containers shown in FIG. 10.

As shown in FIG. 10, each container 50 in outer rows of containers is preferably offset at an angle θ, for instance 30 degrees. This staggered arrangement is contrary to traditional packaging that includes containers positioned in an aligned manner and/or at 90 degree angles relative to each other.

According to one preferred embodiment of the arrangement shown in FIGS. 9 and 10, a center container receiving aperture 26 may be left vacant following application of containers to facilitate a sturdier package 15, to permit insertion of another object, such as a promotional item, in the center container receiving aperture 26; to permit carrying of the resulting package 15; and/or for any other suitable reason. Alternatively, package 15 may include seven containers 50 resulting in additional benefits.

According to one preferred embodiment of this invention, such as shown in FIG. 10, package 15 may occupy approximately 5% less shelf space per container than a standard two by three array (or "six pack") package. As a result, bottlers and/or consumers may receive the benefit of more containers per package than a traditional package. Retailers may thus display and/or stock more product due to increased density of containers in 30 degree configurations rather than 90 degree (rectangular) configurations. In addition, a hexagonal package 10 such as shown in FIG. 10 is particularly stable because each container generally contacts at least 3 other containers at a span of at least about 120 degrees.

Flexible sheet 20 of material is preferably cut, using means known to those skilled in the art, such as a stamping die, to form a plurality of container receiving apertures 25 in flexible sheet 20, such as shown in FIGS. 1 and 2. Container receiving apertures 25 are preferably formed in a rectangular shape having rounded or radiused corners and extending longitudinally across flexible carrier 10 to sufficiently engage and retain a respective container. As shown in FIGS. 1 and 2, second row having a single container receiving aperture 25, may include a different geometry, such as the more rounded geometry shown.

Container receiving apertures 25 preferably extend lengthwise or longitudinally along flexible sheet 20 so that a length of each rectangular container receiving aperture 25 is aligned longitudinally along flexible sheet 20 and a width of each rectangular container receiving aperture 25 is aligned transversely along flexible sheet 20. Flexible sheet 20 may include other configurations of container receiving apertures 25 depending on the size of package and/or the number of containers desired.

Flexible carrier 10 is preferably manufactured so that raw carrier stock includes a generally continuous roll of flexible sheet 20 having a plurality of adjacent flexible carriers 10 that are punched and then wound onto a reel or spool (not shown) having several thousand flexible carriers 10, each flexible carrier 10 attached to each adjacent flexible carrier 10. Flexible carriers 10 are later applied to containers to form packages and, during such process, are preferably unwound from the reels, stretched over the containers, cut at selected points to separate and then separated from each other to form individual packages.

Secondary apertures 55 may also be provided between and among container receiving apertures 25. As shown in FIGS. 1, 2 and 7 secondary apertures 55 may be generally triangular-shaped. Secondary apertures 55 may be used to reduce material cost, and to control or modify the size and stretching properties of container receiving portions 30.

The containers to be inserted in container receiving apertures 25 may be bottles or cans having varying shapes and diameters. Carrier receiving portions 30 are installed around the respective containers while stretched, and are allowed to retract or recover to provide a snug fit around the rib, chime or outside sidewall surface of the respective containers.

As shown in FIG. 5, flexible carrier 10 may further or alternatively include an integral display panel 80 extending longitudinally along one side of flexible sheet 20. Display panel 80 may include printed advertising or billboard space, either directly applied to flexible sheet 20 or applied with an adhesive label, such as shown in FIG. 5. According to this embodiment of the invention, one or more panel apertures 90 are preferably positioned between display panel 80 and remainder of flexible sheet 20. Panel aperture 90 preferably includes a notch or indentation extending between each container receiving aperture 25 positioned within flexible sheet 20. Panel apertures 90 preferably urge display panel 80 into a generally vertical alignment with the vertical sidewalls of the containers within package.

The flexible sheet 20 used to form the flexible carrier 10 is desirably a polymeric or plastic sheet, which can be formed by an extrusion process and then cut to form flexible carrier 10. The flexible sheet 20 has a thickness which provides sufficient structural integrity to carry a desired number of containers. For instance, each flexible carrier 10 may be designed to carry three, five, seven, nine, eleven or thirteen or more containers of a desired product having a specific weight, volume, shape and size. For most applications, the flexible sheet 20 may have a thickness of about 3-50 mils, suitably about 5-30 mils, commonly about 10-20 mils.

While in the foregoing specification this invention has been described in relation to certain preferred embodiments thereof, and many details have been set forth for purpose of illustration, it will be apparent to those skilled in the art that carrier 10 and the related method of manufacture are susceptible to additional embodiments and that certain of the details described herein can be varied considerably without departing from the basic principles of the invention.

The invention claimed is:

1. A flexible carrier for carrying a plurality of containers, said carrier comprising a flexible sheet of material and a plurality of container-receiving apertures formed therein, each container-receiving aperture for receiving a container therein, said carrier having a longitudinal direction and a transverse direction, said carrier comprising:

an array of the container-receiving apertures including first, second and third adjacent longitudinal rows of aligned apertures wherein there exists one aperture in said second row that spans two adjacent apertures in each of said first row and third row such that a transverse axis extending from one longitudinal extent of said one aperture intersects a first aperture in each of said first row and said third row and a transverse axis extending from the opposite longitudinal extent of said one aperture intersects a second aperture in each of said first row and said third row, wherein the container receiving apertures in said first row and said third row include a different geometry than the container receiving apertures in said second row.

2. The flexible carrier of claim 1 further comprising a pair of handles, a handle extending from each of an outside of the first row and an outside of the third row.

3. A flexible carrier for carrying a plurality of containers, comprising a flexible sheet and a plurality of container receiving apertures formed in the flexible sheet, each container receiving aperture for receiving a container, the flexible carrier comprising:

a staggered array of the container receiving apertures extending longitudinally in three rows, a first row and a third row having an even number of the container receiving apertures and a second row positioned between the first row and the third row, the second row having an odd number of the container receiving apertures wherein at least one container of the plurality of containers in the second row contacts at least two containers of the plurality of containers in each of the first row and the third row following application of the flexible carrier to the plurality of containers, wherein the container receiving apertures in the first row comprise a different geometry than the container receiving apertures in the second row.

4. The flexible carrier of claim 3 wherein the first row and the third row comprise the same number of the container receiving apertures.

* * * * *